US011499703B1

(12) United States Patent
Smith

(10) Patent No.: US 11,499,703 B1
(45) Date of Patent: Nov. 15, 2022

(54) DECORATIVE LIGHT STRAND WITH VOLTAGE DROP MITIGATION AND METHOD OF USE

(71) Applicant: Jordan Farnsworth Smith, Spanish Fork, UT (US)

(72) Inventor: Jordan Farnsworth Smith, Spanish Fork, UT (US)

( * ) Notice: Subject to any disclaimer, the term of this patent is extended or adjusted under 35 U.S.C. 154(b) by 0 days.

(21) Appl. No.: 17/448,698

(22) Filed: Sep. 23, 2021

(51) Int. Cl.
*F21V 23/00* (2015.01)
*F21S 4/10* (2016.01)
*F21W 121/04* (2006.01)
*F21Y 115/10* (2016.01)

(52) U.S. Cl.
CPC ..... *F21V 23/004* (2013.01); *F21S 4/10* (2016.01); *F21V 23/001* (2013.01); *F21W 2121/04* (2013.01); *F21Y 2115/10* (2016.08)

(58) Field of Classification Search
CPC ..... F21S 4/10; F21W 2121/04; F21Y 2115/10
See application file for complete search history.

(56) References Cited

U.S. PATENT DOCUMENTS 4,439,818 A 3/1984 Scheib
4,984,999 A 1/1991 Leake
6,072,280 A 6/2000 Allen
7,605,547 B2 10/2009 Ng
8,094,102 B2 1/2012 Huang
8,926,118 B1 1/2015 Whittaker
9,433,056 B2 * 8/2016 Ding ..... H05B 45/46
9,506,609 B1 11/2016 Groves
9,986,610 B1 5/2018 Loomis
10,117,298 B1 10/2018 Loomis
2020/0116315 A1 * 4/2020 Zhao ..... G06F 3/04847

OTHER PUBLICATIONS

Russel, Arthur, Using DC-DC Converters in Parallel, EE Power, 2016.

* cited by examiner

*Primary Examiner* — Peggy A Neils

(57) ABSTRACT

A decorative light strand having a power distribution modality in which a high voltage wire feeds a power wire which provides a supply voltage to light engines in an effective operational voltage range. The high voltage wire interfaces with the power wire through longitudinally distributed DC voltage regulators that step down a higher voltage to the operational voltage of a number of light engines. An equilibrium voltage is thus achieved such that all light engines are similarly powered. The decorative light elements may be light-emitting diode (LED) light engines with a chip-controlled red-green-blue (RGB) interface, which controls user perceived effects, such as on/off frequency, color, intensity, and color temperature of each light engine at any given time, thus achieving a wide variety of decorative effects. The decorative light strand includes a distribution wire and DC voltage regulator which enables long-strand lights of indiscriminate lengths for custom installations.

20 Claims, 5 Drawing Sheets

DECORATIVE LIGHT STRAND WITH VOLTAGE DROP MITIGATION AND METHOD OF USE

FIELD OF THE INVENTION

The present disclosure generally relates to long-strand decorative lights configured to create attractive, custom displays on exterior and interior structures, in which the lights have a voltage range requirement that cannot be efficiently satisfied by known means in long strands. These displays are useful for festive occasions and dynamic illumination of all kinds. More particularly, in some embodiments a high voltage wire interfaces with a supply wire via DC voltage regulators to evenly distribute voltage to the lights. In addition, the lights may be individually controllable light-emitting diodes (LEDs) having a chip-controlled red-green-blue (RGB) interface, a controller and a signal data wire.

BACKGROUND

Various light strands are known in the art with individually controllable lights. It has long been known to provide tungsten filament christmas-tree lights that blink and scintillate by various wire/resistor/bi-metal/capacitor arrangements. A basic frustration has long been that when one filament in a series light configuration goes out, they all go out. The user must search until the offending light element is found and replaced to restore the others to illumination. These problems have long been solved by well-known means.

The use of more modern elements, such as Light-emitting diodes (LEDs) in festive displays, has vastly improved the quality and durability of strand lights. Nevertheless, they have introduced new challenges. LEDs are known to come in one color, or in red-green-blue (RGB) configurations that can be made to be color variable. Even beyond that, individually controllable RGB LED "engines" can be utilized to create a seemingly infinite variety of colors, tempos, hues and patterns. But these individually controllable engines and other LEDs have critical power and data parameters to reach maximum potential.

Decorative LEDs are typically configured to operate on DC voltage in a range from about 3-12 volts. A number of LEDs might be configured by the manufacturer to optimally operate in a range from 4.5-5.5 volts. If configured such that the product of load current and wire resistance causes a voltage drop that exceeds the minimum threshold for LED operation, the light output becomes weak, dim, or non-existent, starting at the end of the strand (farthest from the current source). Another issue that can become present is degradation of the data signal when there is a large gap between light engines, (wherein the light engines re-broadcast the signal).

Some have dealt with this voltage-drop problem by simply increasing the diameter of the conductor. This is effective for a distance, but it adds cost and is not viable beyond a certain conductor size, due to footprint, flexibility and manufacturing.

Another solution found in the prior art is to reduce the brightness, and thus the power consumption of the LEDs. This has been accomplished by current limiting LED drivers or, in the case of individually addressable LEDs, by instructing them to maintain a lower brightness. This is effective in creating a long-strand LED display with even light output from proximal to the power source, to distant, but the weak over-all light output creates a dull display.

Other attempts have been made to address the voltage drop problem by injecting power on a strand from another source, in the desired voltage. This can be done using an additional power wire that runs alongside the strand or by taking a direct path from the power source to the desired injection point. Significant planning is involved in implementing this solution in a custom installation, electrical calculations or testing must be performed to ensure correct power distribution. Additionally, the physical installation is more complex. This method is in-accessible to unskilled users.

Yet another solution is found in U.S. Pat. No. 6,072,280 to Allen, et al. which describes a system that places small groups of light engines in a series configuration, with the groups being wired in a parallel configuration. For example, a 24 volts DC rail having a plurality of groups, each group having 6 light engines in each group. In this example, 24 volts DC is divided equally among each of the 6 light engines, with each receiving 4 volts DC. The '280 patent only addresses non-addressable light engines. However, were they to be individually addressable, being wired in series and having an uncommon ground, all individually addressable light engines in a group receive the same address and therefore are instructed as one address, wherein they will have identical color output, timing, etc. This combined group produces a uniform and strong light output, however this limits aesthetic options, in that there is no option to produce individualized scintillating light outputs, which is desired in the art. In the case of non-addressable LEDs, the group configuration limits where a strand can be terminated, it may only be cut between groups, so that the series connection remains unbroken.

Another attempt has been made to address the voltage drop problem in U.S. Pat. No. 9,506,609 to Groves, et al. which describes a system which uses voltage regulators on each light engine. A high voltage, which is less susceptible to wire resistance and therefore voltage drop, is used in the main transmission wire along the strand. Each light engine has an associated voltage regulator for the purpose of stepping the higher voltage down to a voltage suitable for LED light engines, about 3-12 volts. Among disadvantages inherent with the solution are the additional cost associated with the components necessary to regulate voltage at each light engine. This increases the physical footprint, which limits installation flexibility and aesthetics. Further, all voltage regulators have inefficiency, wherein power is lost to heat. LED and electronic component life are known to be negatively affected by heat. This solution, by its nature, places a voltage regulator in proximity with each light engine, both of these heat generating sources are prone to heat-related failure, especially the light engine. Notably, having a voltage regulator on each light engine creates an additional failure point multiplied across all the light engines.

Yet another solution is described in U.S. Pat. No. 9,986,610 to Loomis et al. and U.S. Pat. No. 10,117,298 to Loomis et al. which describes the use of a high voltage transmission line in a light strand. However, rather than using a voltage regulator at each light engine, voltage regulators are attached to segments, with a given number of light engines in-between. Each voltage regulator has a low voltage transmission line connected to the output of the voltage regulator and directly connected to the number of light elements in the given segment. While the high voltage line is continuous along a plurality of segments, the low voltage line begins at the output of each voltage regulator and terminates at the end of each segment. This distinction, whereby the low voltage line is non-continuous, was so designed due to challenges associated with having output connected voltage regulators. These challenges include uneven current sharing and transient voltages created in output connected switching voltage regulators, (which is discussed further in the following paragraph). However, this distinction, whereby the low voltage line is non-continuous, also creates disadvantages. Whereby the segment is manufactured with a voltage regulator, a low voltage line that terminates, and start and end connectors, this causes segments joined together in a strand to be inflexible, in that the segments may not fit the length profile of a given feature that is to be lighted. One could bypass this impairment by trimming the ends of segments from a manufactured length to a desired length. However, under this paradigm, wherein a segment is trimmed, a full-length segment could be running its voltage regulator at near full capacity, while a half-length segment would run at under half capacity. This results in voltage regulators which are not running at optimal designed loads and therefore lower efficiency. Additionally, voltage regulators running at higher loads are more likely to fail quickly when compared to voltage regulators running at lower loads. Most importantly, under all paradigms within the '610 and '298 patents, if any single voltage regulator fails its entire attached segment will also fail.

Those skilled in the art understand that some attempt has been made to address challenges associated with paralleled DC voltage regulators. Which challenges include uneven current sharing (caused by minor differences in output voltage due to manufacturing tolerances), and transient voltages caused by non-synchronization of the voltage regulators. Both of these challenges can result in dysfunction, component stress and premature failure. Attempts to address these issues include techniques such as 'droop sharing' using a ballast resistor and 'diode OR-ing', both methods reduce regulation efficiency, among other issues. Another method uses a master-slave control strategy with communication between voltage regulators; of course, this requires an extra conductor for communication, which is a disadvantage especially in scenarios with voltage regulators separated by distance. Alternatively wireless communication could be used; however, this requires costly components. In both scenarios the added communication components reduce reliability. Additionally, if a 'master' voltage regulator fails, it brings down the entire system. These concepts are further explained in the attached article: Russel, Arthur, "Using DC-DC Converters in Parallel," EE Power, 2016.

The above shown solutions in the prior art have been developed to address voltage drop in light strands, all have demonstrated inherent disadvantages. Notable disadvantages in this summary include increased cost, aesthetic limitations, increased footprint, decreased reliability and custom installation inflexibility. Therefore, it is desirable to develop a decorative light strand with voltage drop mitigation that mitigates against known problems, deficiencies and/or inefficiencies in the prior art.

SUMMARY OF THE INVENTION

The following summary of the invention provides a basic understanding of some aspects and features of the invention. This summary is not extensive, and as such is not intended to particularly identify all key and critical elements of the invention, or to delineate the scope of the invention. Its sole purpose is to present some concepts of the invention in simplified form as a prelude to the more detailed description presented below.

Aspects of the invention provide for a decorative strand light with a plurality of light engines. The light engines are powered at a relatively low operating voltage by a direct power wire. A negative wire is also provided in connection with each of the light engines to complete electrical circuits in the light engines. The light engines and wire act as resistive loads that diminish voltage along the strand in the circuits created by the direct power wire, the light engines and the negative wire. According to the aspects of the invention, a relatively high voltage is provided by a high voltage wire in connection with segments of the direct power wire and the negative wire. The connection of the high voltage wire to the light engine circuits is made by way of DC voltage regulators attached to sequential segments of the light strand. The voltage regulators cooperate to step the voltage down from the high voltage of the high voltage wire to the operating voltage of the light engines.

According to aspects of the invention, the plurality of light engines have a voltage operating range in which both overvoltage and undervoltage have disadvantages. The high voltage wire in combination with segments of the direct power wire assures equilibrium operating voltage. Separate from voltage, the light engines of a preferred embodiment may be controlled by a chip to achieve a variety of luminescent qualities and intensities. A data wire may be provided in which a data signal separately provides instructions to the light engines.

BRIEF DESCRIPTION OF THE DRAWINGS

The accompanying drawings, which are incorporated in and constitute a part of this specification, exemplify the preferred embodiments of the present invention and, together with the description, explain and illustrate principles of the invention. The drawings are only intended to illustrate major features of the exemplary embodiments in diagrammatic manner. The drawings do not depict every feature of every embodiment, nor do they depict relative dimensions of the depicted elements and are not drawn to scale.

DETAILED DESCRIPTION

Figure 1:
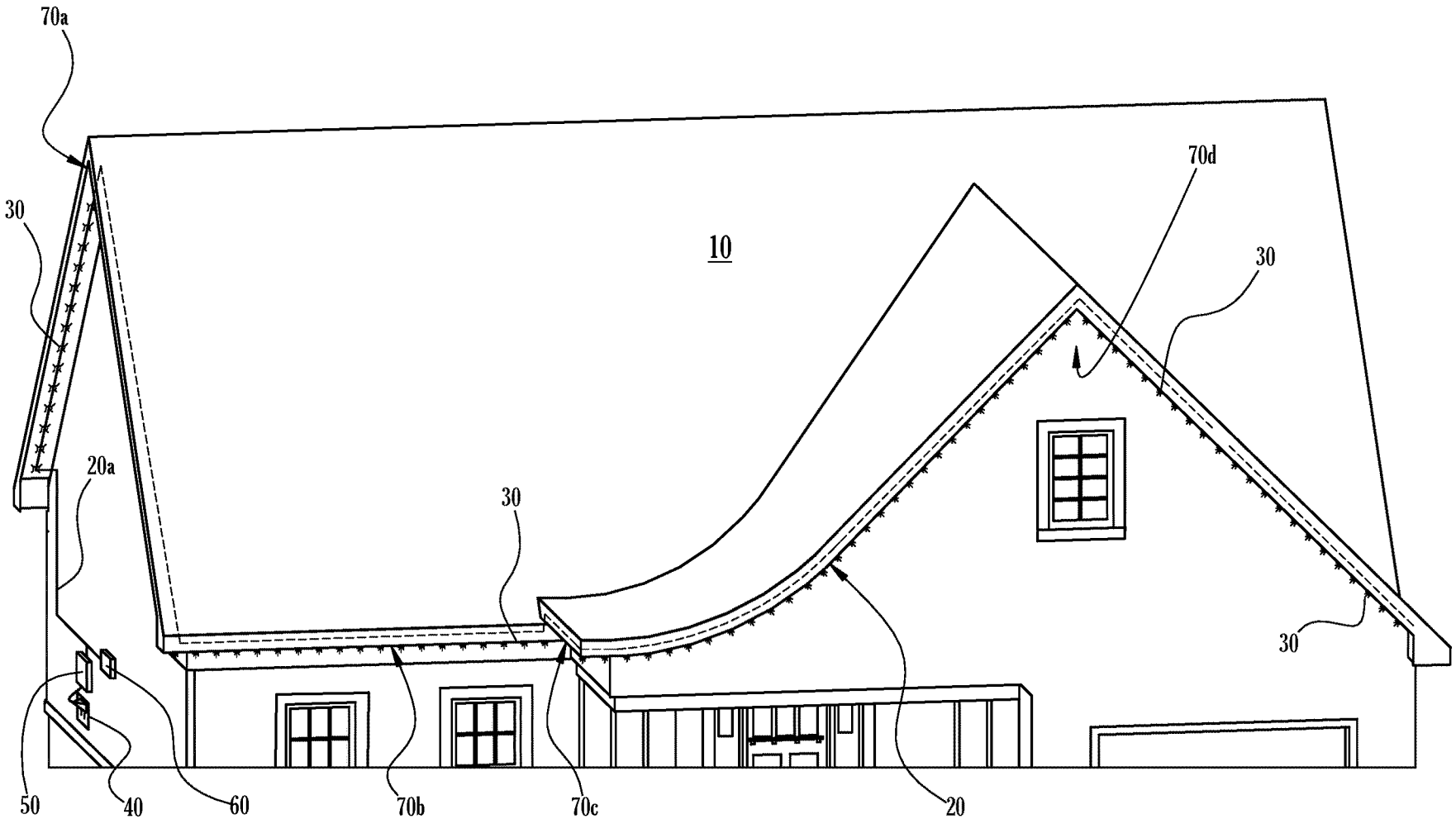
FIG. 1 is a perspective illustration of a roof line of a building structure decorated with a custom-length light strand.

Reference will now be made, in detail, to illustrative embodiments, one or more examples of which are illustrated in the drawings. Like components and/or items in the various drawings are identified by same reference numbers, and each example is provided by way of explanation only and thus does not limit the invention. It will be apparent to those skilled in the art that various modifications and/or variations can be made without departing from the scope or spirit of the invention. For instance, in many cases features illustrated or described as part of one embodiment can be used with another embodiment to yield yet another embodiment. Thus, it is intended that the present disclosure covers such modifications and variations as come within the scope of the appended claims and/or equivalents.

FIG. 1 is a perspective view of a building structure 10 decorated with a light strand 20. The light strand 20 is comprised of a number of light engines 30. The light strand 20 is initially powered, in this instance, by a typical one hundred twenty volt AC power source 40, found in nearly any residential or business structure in the United States. As the light strand 20, is powered by DC voltage, an AC-DC power supply 50 is provided to convert the AC voltage from the power source 40 to DC voltage, to power the light strand 20.

Also provided is a digital controller 60. The digital controller 60 creates a digital signal for controlling light engines 30 of the light strand 20. The general function of digital controller 60, is to generate a digital signal to control individual light engines 30. The light strand 20 is connected to the power source 40 and the digital controller 60, by a leader wire 20*a* of the light strand 20. In this embodiment, the leader wire, 20*a* is constructed of typical 3-strand wire as will be further specified in relation to FIG. 2, herein below. Leader wire 20*a* is of a length chosen to facilitate connection of the power supply 50 and the lighted section of the light strand 20. For custom design it may be aesthetically desirable to distance the lighted portions of the light strand 20 from functional portions comprising the AC power source 40, the AC-DC power supply 50, and the digital controller 60. This distance is custom fitted to the individual application by selecting a desired length for the leader wire 20*a*.

Light strand 20, is comprised of a number of sequential individual light engines 30, sufficient to populate the desired aspects of the building structure 10, in a decorative manner. In this instance, the light strand 20 (and, consequentially, the light engines 30) continuously runs the length of the eaves of gable 70*a*, run 70*b*, run 70*c* and gable 70*d*. It will be understood by one of ordinary skill in the art, that the resulting decoration of the structure 10, along the soffits of eaves 70*a*, 70*b*, 70*c* and 70*d* creates an aesthetic and functional lighting scenario complementary to the building structure 10.

It will be appreciated that light strand 20 may be affixed to structure 10 by means of fasteners such as nails, screws, rivets, clamps, adhesives, channels, or any other fastener type now known to one of ordinary skill, or which may become known.

It will be understood that building structure 10 is only exemplary. It will be further understood that other structural elements or sub-structures (not specified) can be continuously decorated with a continuation of light strand 20, in accordance with convention. These non-specified elements could be additional eaves, runs, windows, dormers, ground-based decorations, bushes, trees, etc. This can be accomplished by means of a continuation of the lighted portion of light strand 20, or by means of addition of one or more segments similarly constructed to leader 20*a*, which can be inserted at any place in light strand 20. Light strand 20 of the present invention could be multiplied in a variety of structures, a yard, garden, business or community, or even on a ground-scape to create a coordinated decorative effect. Light strands made in accordance with the present invention can also be branched from one structural element to multiple elements.

The relation of the light strand 20 to the building structure 10 will be different in every application. One point of the invention is that light strand 20 can be produced in sufficient lengths to continuously decorate any structure and which is terminable at virtually any desired length.

Figure 2:
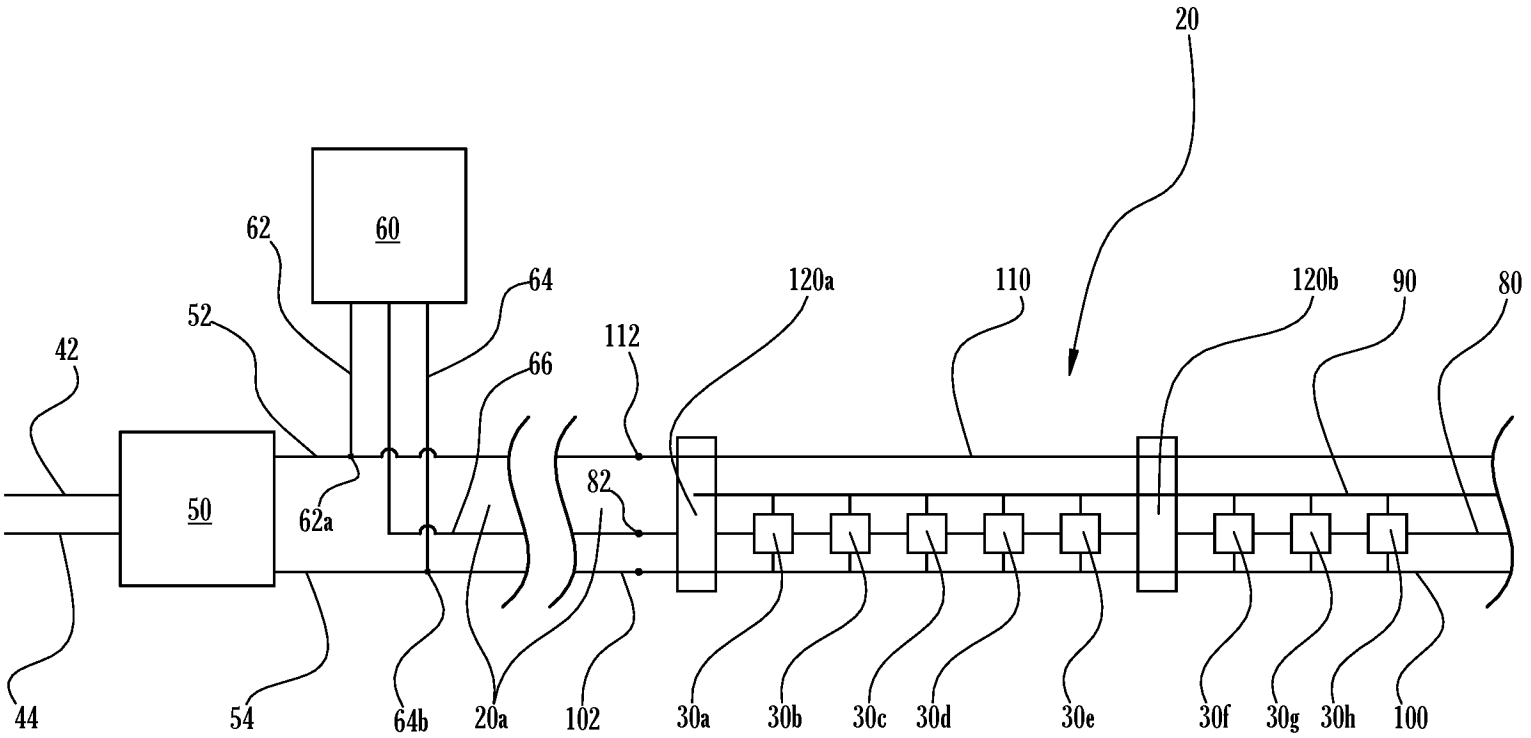
FIG. 2 schematically diagrams a decorative light strand having a power supply and distribution modality.

FIG. 2 is a schematic diagram showing the detail of the light strand 20 of FIG. 1 comprising power supply 50, digital controller 60, and light engines 30*a*-30*h*. The power supply 50 is connected to the AC power source 40 (FIG. 1) by means of an AC line wire 42 and AC neutral wire 44. The power source 50 further comprises DC positive leader wire 52 and DC negative leader wire 54. The DC positive leader wire 52 and DC negative leader wire 54 comprise a forty-eight volt DC circuit, in this preferred embodiment.

The DC positive leader wire 52 is connected to the digital controller 60 by means of a data DC positive wire 62 to power the digital controller 60 via connector 62*a*, and a data DC negative wire 64 via connector 64*b*. The digital controller 60 has a data output wire 66 that functions to individually control the individual light engines 30. The DC positive leader wire 52, DC negative leader wire 54 and a data output wire 66, comprise the leader wire 20*a* of light strand 20. As previously described, the length of the leader wire 20*a* is chosen to address the length desired to aesthetically distance the beginning of the lighted portion of the light strand 20 from the functional elements comprising AC power source 40 (FIG. 1), AC-DC power supply 50 and digital controller 60.

Light strand 20 has a lighted portion comprising a plurality of light engines 30*a*-30*h*, a signal data wire 80, a direct power wire 90, a negative wire 100, a high voltage wire 110, and a plurality of DC voltage regulators 120*a* and 120*b*, which in this preferred embodiment are switching voltage regulators. Alternatively, linear voltage regulators could be used. The signal data wire 80 is connected to the data output wire 66 by means of connector 82, the negative wire 100 is connected to the DC negative leader wire 54 by means of connector 102, and the high voltage wire 110 is connected to the DC positive leader wire 52 by means of connector 112. The direct power wire 90 runs the length of the lighted portion of light strand 20 and is segmented into segments, as will be described in more detail in FIG. 4. Likewise, negative wire 100 runs the length of the lighted portion of light strand 20 and is segmented into segments in a similar manner as direct power wire 90. This arrangement of segmenting power wire 90 and negative wire 100, and flanking each segment by a voltage regulator 120, is repeated for the length of the lighted portion of light strand 20.

Digital controller 60 in this preferred embodiment consists of various components which will be understood by one of skill in the art and, therefore, are not specifically depicted in a drawing. Nevertheless, digital controller 60, in this embodiment comprises a voltage regulator that regulates DC voltage down to five volts, which is usable by an ESP32 control chip, made by Espressif Systems. This chip can communicate wirelessly with computing systems, such as handheld smartphones in order to create a graphical user interface and control mechanism for the user. User inputs are translated to a digital signal provided to signal data wire 80 in order to control light engine 30 function. Data can also be stored for later use by the user. In other embodiments a myriad of other digital signal generators could be used by one skilled in the art, this could include simple electrical components that generate a signal for a static display or signal generators that can communicate by various means wired or wirelessly, in order to provide control to the user.

Figure 3:
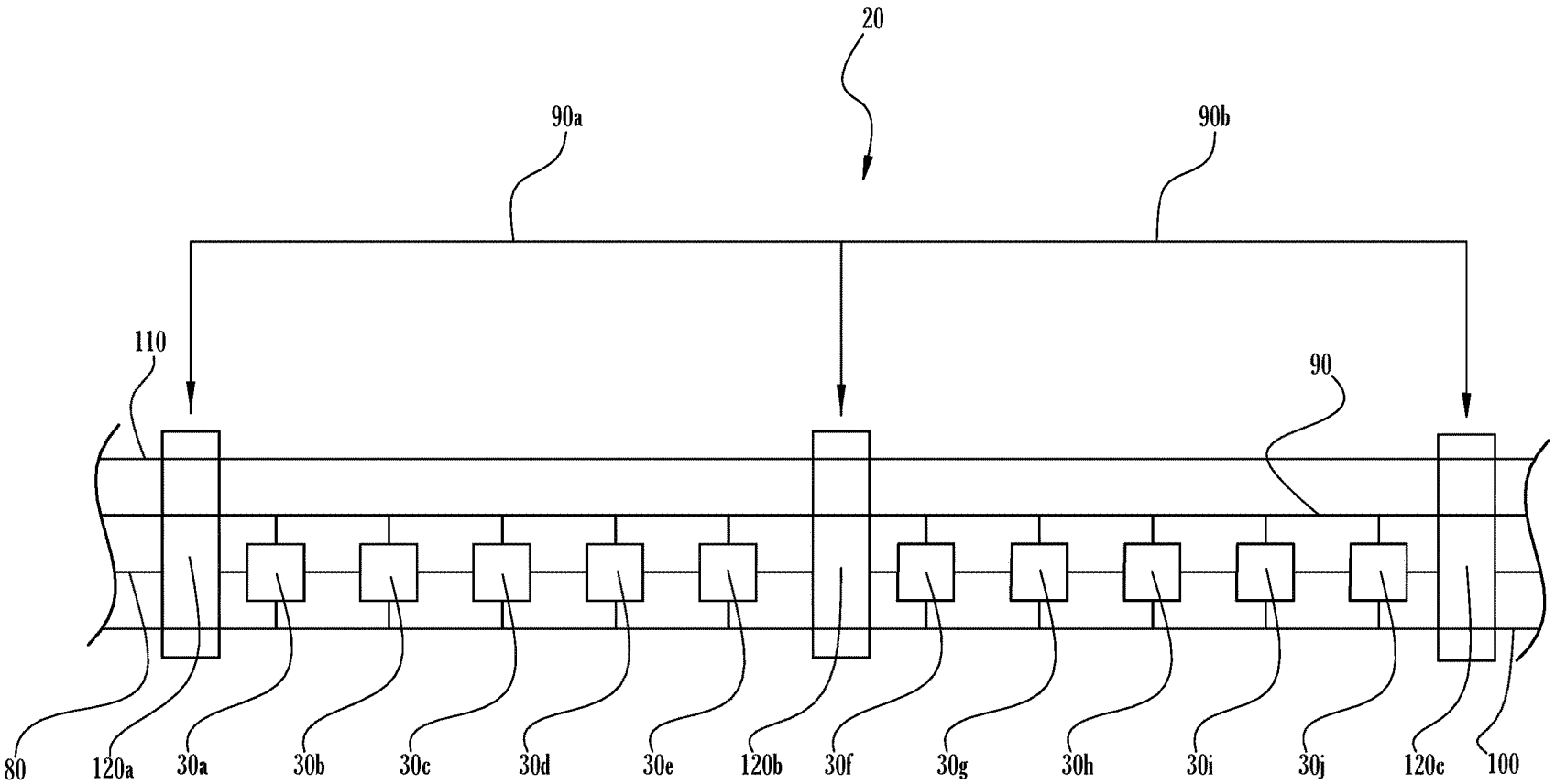
FIG. 3 is a circuit schematic diagram of the decorative light strand of FIG. 2 showing increased detail of the lighted portion.

FIG. 3 shows detail of the lighted portion of the light strand 20 of FIG 2. High voltage wire 110 is powered, in this embodiment, at forty-eight volts DC by the AC-DC power supply 50. Although forty-eight volts DC is specified, in this instance, it will be recognized that it is only desirable to choose a voltage higher than needed to power the light engines 30, and sufficient to meet the needs of the total length of the lighted section, however long. When selecting a voltage for the high voltage wire 110, it will also be recognized that the operating range of the voltage regulators 120, will be chosen accordingly. The high voltage wire 110 powers all voltage regulators 120 in the lighted segment of the light strand 20. The voltage in the high voltage wire 110 is less affected by wire resistance, and, therefore, less affected by voltage drop, than a lower voltage would be.

Figure 4:
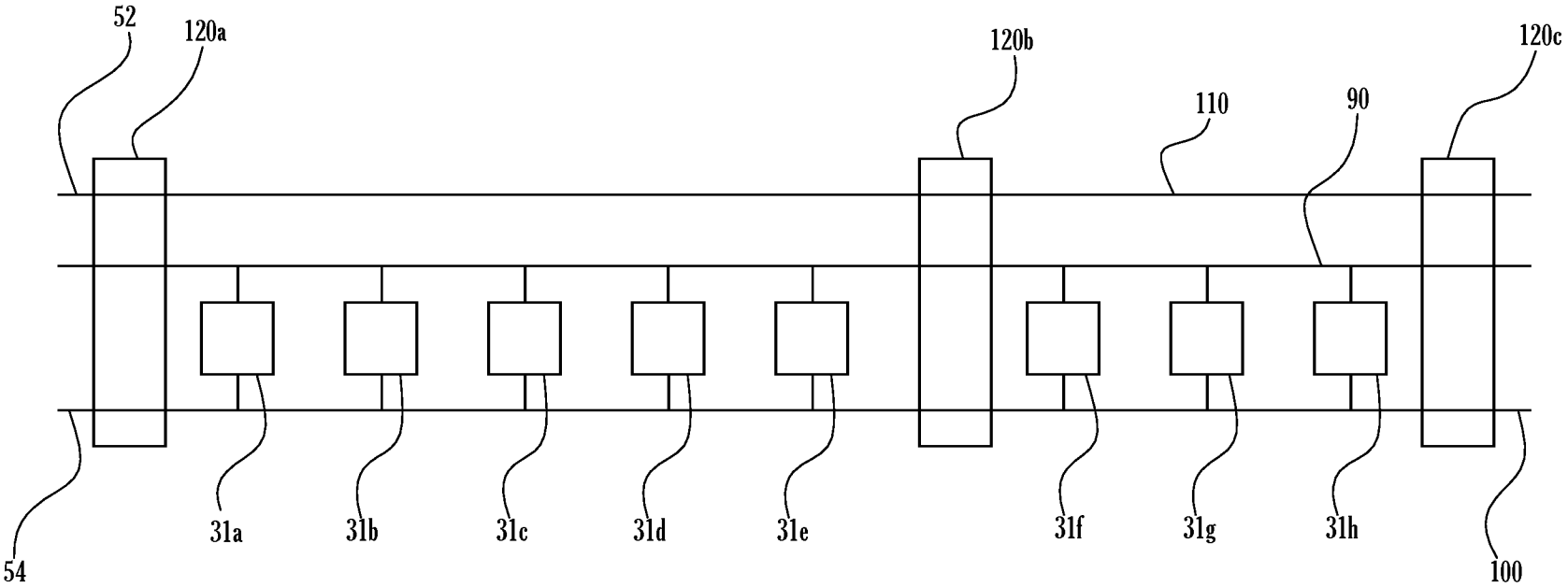
FIG. 4 is a circuit schematic diagram of an alternative embodiment of a decorative light strand made in accordance with the present invention.

Voltage regulator 120*a* is connected in parallel to the high voltage wire 110, direct power wire 90, negative wire 100 and in this preferred embodiment the signal data wire 80. Voltage regulator 120*a* is supplied with DC power from the high voltage wire 110 and provides DC power to the direct power wire 90, in this preferred embodiment the output voltage of voltage regulator 120*a* is 5 volts DC. The output power of the voltage regulator 120*b*, is supplied to most proximal light engines 30*e* and 30*f* (and likely 30*d-g*) through direct power wire 90. Voltage regulator 120*b* may supply power to any light engine 30*a*-30*j*; but is decreasingly likely to supply power to any light engine 30, as they become more distant, such as light engine 30*a* or 30*j*. In this embodiment voltage regulator 120*b* will generally supply power to light engines 30*d*-30*g* due to current being equally shared between voltage regulators 120*a*, 120*b* and 120*c*. Current sharing is largely possible due to the resistance and inductance inherent in direct power wire 90 which isolates the individual voltage regulators 120. Reference will be made to FIG. 4 to elaborate on this principle. The reliability of this invention is demonstrated in a circumstance where voltage regulator 120*b* fails, in this case voltage regulator 120*a* and 120*c* will supply power to all light engines 30*a*-30*j* and maintain an equilibrium voltage.

Voltage regulator 120*b* is identical in design to voltage regulator 120*a* and is similarly connected in parallel to the high voltage wire 110, direct power wire 90, negative wire 100 and, in this preferred embodiment, the signal data wire 80. Voltage regulator 120*b* is similar in behavior to voltage regular 120*a* in that it supplies power to light engines 30, however it supplies power to any light engine 30 that is placing a load on it; in this diagram, voltage regulator 120*b* is most likely to supply power to light engines 30*d*-30*g*. Similarly, voltage regulator 120*c* is identical in design and is most likely to supply power to light engines 30*i*-30*l* (not depicted).

In this diagram five light engines 30 are displayed per segment 90*a* or 90*b* for ease of illustration, in the preferred embodiment fifty light engines 30 have been found to be optimal in conjunction with the type of voltage regulator 120 which we have used, also with typical light engine spacing (about 4-12 inches). In this preferred embodiment, twenty-two American wire gauge (AWG) is used. In a light strand 20, wire gauge impacts both electrical properties and mechanical strength. Mechanical strength is considered since the wire may need to support light weight loads and may need to bend and flex. Mechanical strength can be improved with insulator thickness in addition to wire gauge. Electrical properties should also be considered when selecting a wire gauge. It will be understood by someone of ordinary skill in the art that a trace on a printed circuit board could substitute for the wire and insulator in this embodiment. Flexible printed circuit boards with surface mount light engines 30 are common in the art, they directly function with and correlate to this invention.

In this preferred embodiment, the signal data wire 80 enters and exits voltage regulator 120*a*. Voltage regulator 120*a* contains a Schmitt trigger which squares the signal waveform, other methods common in the art for digital signal conditioning can be used. This may be necessary when signal degradation occurs in long runs of plain wire without light engines due to wire resistance and other factors. Normally, signal waveforms are reformed in the light engine, which does not occur naturally in plain wire.

Light engines 30*a*-30*j* are connected in parallel to direct power wire 90 and negative wire 100. In this preferred embodiment each light engine 30*a*-30*j* has a data signal 'in' connection that accepts data and a data signal 'out' connection that broadcasts the signal to the next light engine in sequence, thus continuing signal data wire 80. In another embodiment light engine data signals could be transmitted over a power wire. In this preferred embodiment light engines 30 are WS2812 components from Worldsemi, Co. Any individually addressable light engine could be used. Examples of individually addressable light engine suppliers include Cree LED and Osram. Reference will be made to further detail on light engines 30 in relation to FIG. 6.

FIG. 4 depicts a second preferred embodiment of light strand 20, which comprises a plurality of light engines 31, a direct power wire 90, a negative wire 100, a high voltage wire 110, and a plurality of voltage regulators 120. In this preferred embodiment, the direct power wire 90, negative wire 100, high voltage wire 110, and a plurality of voltage regulators 120 that are constructed, operate, and interact in the manner described in relation to the first preferred embodiment. Similarly, they are operated by an AC-DC power supply 50 and an AC power source 40 (not depicted here) in the same manner. The light engines 31, are, in this embodiment, simplified from the preferred embodiment of FIGS. 2 & 3, in that they are non-addressable by a signal data wire 80. The light engines 31 of this embodiment may be individually selected for static color and brightness characteristics and will be selected based on design criteria requirements of the individual environment of each light engine 31*a-h*. They may all be the same, or they may all be different. In this preferred embodiment, the light engines 31 are selected to perform at voltage and power tolerances consistent throughout the display. However, as with the first preferred embodiment, the voltage and power tolerances can vary, and the load will be adjusted by the nature and arrangement of the voltage regulators 120.

In this embodiment the light engines 31 could be individually addressable and controllable using wireless communication found in each light engine 31. This would be a substitute for signal data wire 80 found in FIGS. 1-3. This is accomplished by wireless means understood by one of ordinary skill in the art.

Figure 5:
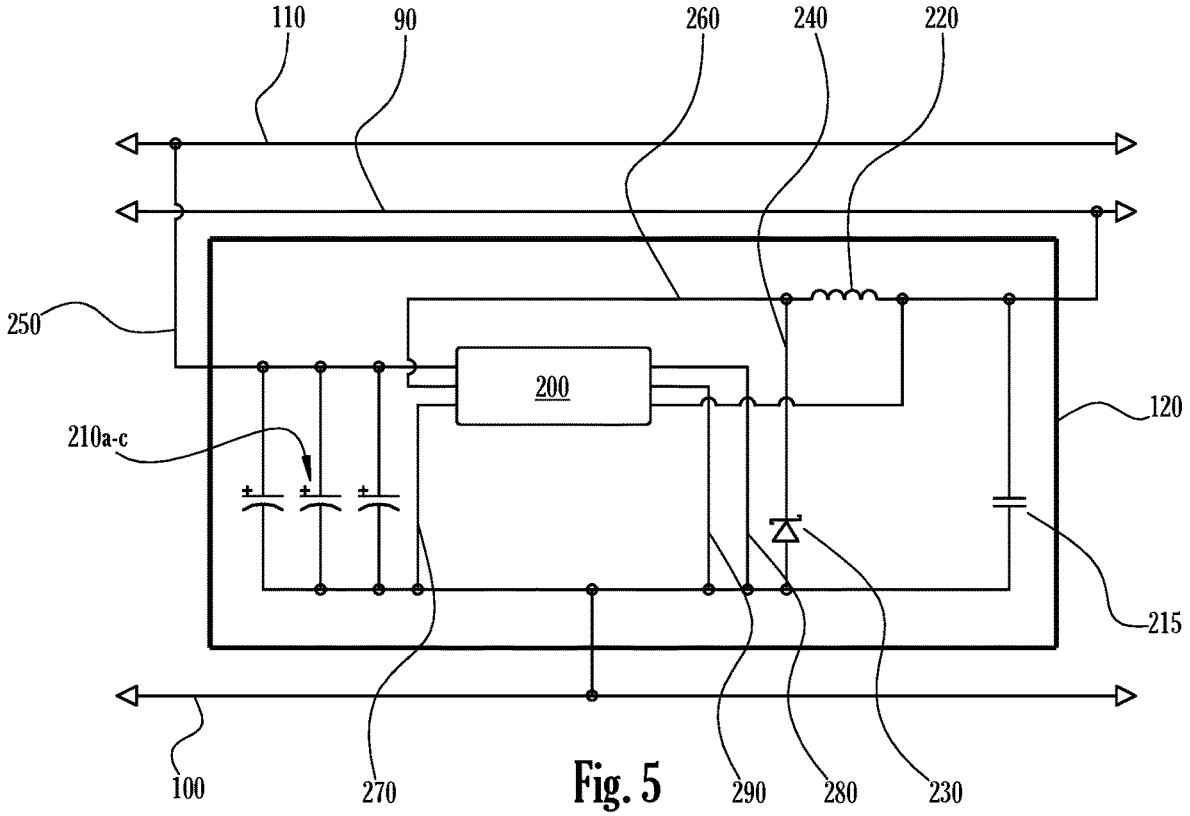
FIG. 5 is a detail circuit schematic diagram depicting a voltage regulator as configured in the present invention.

FIG. 5 depicts detail of voltage regulators 120, which in this preferred embodiment is a switching voltage regulator that steps down DC voltage, also known as a buck converter. It comprises a switching voltage regulator integrated circuit 200, capacitors 210, an inductor 220, and a diode 230. Power is supplied to the switching voltage regulator integrated circuit 200 from the high voltage wire 110 through the input line 250. Capacitors 210*a-c* filter voltage transients. The voltage regulator 120 proceeds to function in a manner common in the art. The switching voltage regulator integrated circuit 200 contains a switch which, when open, allows current to flow through output line 260 and charge the magnetic field of inductor 220. Excess voltage may also charge, or be released from, capacitor 215 as it functions as a filter. Diode 230 is reverse biased when the switch in the switching voltage regulator integrated circuit 200 is open, when closed it allows current to pass back to output line 260 and out to direct power wire 90. Thus, in this manner which is common in the art, forty-eight volts DC is stepped down to five volts DC in this preferred embodiment. Also, part of the operation is ground line 270 which connects switching voltage regulator integrated circuit 200 to negative wire 100. Pad 280 serves the same purpose in addition to providing thermal dissipation. When grounded On/Off line 290 communicates to switching voltage regulator integrated circuit 200 it maintains an 'On' state.

When voltage in feedback line 240 is below what is programmed, switching voltage regulator integrated circuit 200 increases switching frequency and therefore output voltage. Alternatively, when feedback line 240 is below desired voltage, switching voltage regulator integrated circuit 200 decreases switching frequency to decrease output voltage. Voltage regulators 120 feedback lines 240 are unaffected by other voltage regulators due to the isolation resistance provided by segment length of direct power wire 90. In this preferred embodiment direct power wire 90 resistance is sufficient to isolate voltage regulators 120 and enable current sharing and mitigate any voltage regulator 120 out-of-sync voltage ripple.

Figure 6:
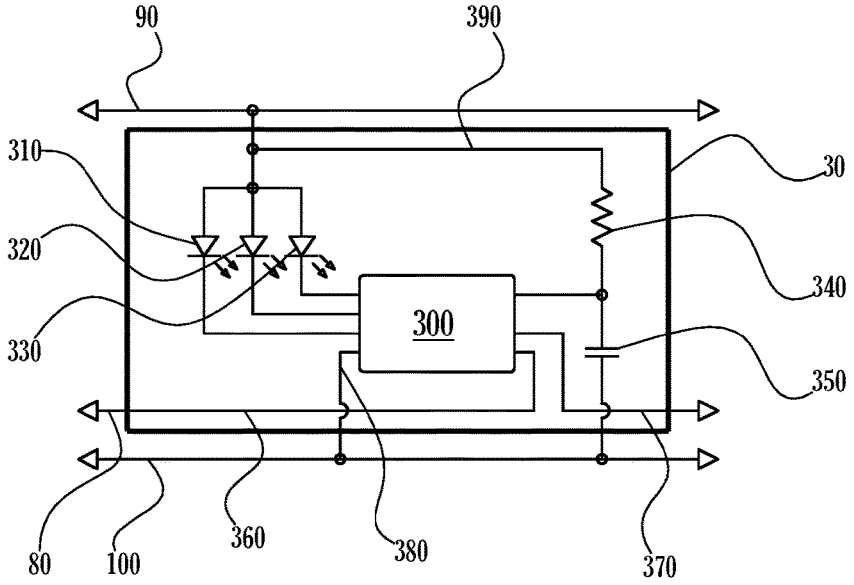
FIG. 6 is a detail circuit schematic diagram depicting an exemplary light engine as configured in the present invention.

FIG. 6 depicts the detail of a light engine 30, in this preferred embodiment a WS2812 component from Worldsemi, Co. Power passes from direct power wire 90 to power wire 390 where it is regulated by resistor 340 before powering light engine integrated circuit 300 or being bypassed to capacitor 350. Signal data wire 80 passes digital information through data in line 360 and into light engine integrated circuit 300, which uses this information to complete a circuit between the red LED 310 and/or green LED 320, and/or blue LED 330, through ground line 380 and to negative wire 100. Completion of a circuit causes illumination. On/off cycles can occur at a low frequency, in order to appear dim to a viewer, or at high frequencies so as to appear brighter. Additionally, combinations of frequency can be programmed amongst red LED 310 and/or green LED 320, and/or blue LED 330 to create illumination that coalesces and appears as another color to a viewer. The data signal is rebroadcast through data out line 370 to the next light engine 30 in sequence. In this preferred embodiment the light engine 30 light system is an individually addressable RGB LED system, other embodiments could utilize non-addressable RGB systems or non-addressable single-color LEDs. In this preferred embodiment the structure is a through-hole LED with a translucent polymer enclosure with each through-hole lead attached to the requisite wire, direct power wire 90, signal data wire 80 and negative wire 100. Other embodiments could use a printed circuit board (PCB) surface mount light engine being attached to a small PCB which is attached to direct power wire 90, signal data wire 80 and negative wire 100. Alternatively, the surface mount light engine could be directly attached to a rigid or flexible elongate PCB.

In this embodiment the term light engine 30 has been used to describe an LED enclosed in a structure that can easily be mounted as a surface mount or through-hole electronic component to a PCB or attached to wire conductors. Light engines 30 can be individually addressable or non-addressable, as well they can contain single or multiple colors, such as RGB. The term light element describes any lighting technology that operates in a narrow tolerance, low voltage DC range, all the same variations in terms or mounting, addressability and color apply to light elements, as well. Developments in the LED space, and in lighting as a whole, could result in future lighting technology that could benefit from the voltage moderation technology of this invention.

LABORATORY EXPERIMENT

Reference will now be made to a physical experiment conducted in conjunction with an embodiment of the light strand of the present invention. On Jun. 25, 2021 the inventor completed construction of a light strand comprising 4 segments, each having 50 light engines (spaced 4 inches apart) and 4 voltage regulators (one at each segment), and an AC-DC power supply. The light engines being part number: WS2812, from WorldSemi, Co. The voltage regulators being 24 volts DC to 5 volts DC, part number: OS-1205CME-3A, from OSKJ/Satistronix Group. The AC-DC power supply being a one hundred twenty volts AC to twenty-four volts DC power supply, part number: HLG-120H-24A, from Mean Well Enterprises. The light engines and voltage regulators were wired according to the detailed description of this invention using 22 AWG gauge copper wire. A controller was included and programmed to control the lights in a variety of loads, patterns and colors, continuously 24 hours per day, seven days per week. During the experiment the ambient temperature remained at 68-75 degrees Fahrenheit. Load readings were taken at random intervals throughout the test with a clamping current meter at the output of each voltage regulator. The average load on each regulator was the following, Regulator 1a: 1.22 amps, Regulator 2a: 1.24 amps, Regulator 3a: 1.36 amps, Regulator 4a: 1.84 amps. Another strand with identical set up was started at the same time and recorded the following. Regulator 1b: 1.21 amps, Regulator 2b: 1.25 amps. Regulator 3b: 1.3 amps. Regulator 4b: 1.9 amps. Results demonstrate the current sharing capabilities of this invention. These strands were powered up on that day and have been in continuous use from then, to the filing date of this application. No failures have occurred in components, neither have significant changes occurred in output currents or other electrical parameters.

Another test was conducted beginning Aug. 31, 2021 using second duplicate strands, light engines and voltage regulators identical in manufacture to those used in the previous test. In this test two segments of 50 light engines were connected in sequence, however 2 voltage regulators were wired proximate to each other. This test was conducted 3 times, each time with the same strand of light engines but with a different set of voltage regulators. In test A, voltage regulator 1 produced 1.66 amps at 5.00 volts, voltage regulator 2 produced 0.24 amps at 4.97 volts. In test B, voltage regulator 3 produced 0.02 amps at 4.96 volts, voltage regulator 4 produced 1.91 amps at 5.02 volts. In test C, voltage regulator 5 produced 0.37 amps at 4.99 volts, voltage regulator 6 produced 1.51 amps at 5.01 volts. This test demonstrated how manufacturing tolerances in the electrical components of voltage regulators can negatively affect current sharing on non-isolated voltage regulator circuits.

The invention claimed is:

1. A decorative light strand comprising: a plurality of individually addressable light engines spaced along a length; a signal data wire in electronic communication with the plurality of light engines; a direct power wire having a voltage and longitudinal segments, said direct power wire electrically connected to the plurality of light engines; a negative wire electrically connected to the plurality of light engines; a high voltage wire extending the length, said high voltage wire comprising a voltage in excess of the voltage of the direct power wire; said decorative light strand further comprising a plurality of DC voltage regulators arrayed over the length of the high voltage wire and in electrical connection with corresponding longitudinal segments of the direct power wire such that each light engine is powered at an equilibrium voltage.

2. The decorative light strand of claim 1 wherein the plurality of light engines further comprise LEDs.

3. The decorative light strand of claim 2 wherein the LEDs further comprise RGB groups.

4. The decorative light strand of claim 1 wherein the voltage of the high voltage wire is in excess of 23 volts and the voltage of the direct power wire is less than 13 volts.

5. The decorative light strand of claim 1 wherein the voltage regulators are switching voltage regulators.

6. The decorative light strand of claim 1 wherein the signal data wire, direct power wire, negative wire, and high voltage wire are traces on an elongate printed circuit board.

7. The printed circuit board of claim 6 wherein the elongate printed circuit board is flexible.

8. The decorative light strand of claim 1 wherein a number of light engines between each DC voltage regulator is between 5 and 100.

9. A decorative light strand comprising: a multitude of light elements spaced along a length; a signal data wire in electronic communication with the multitude of light elements; a direct power wire having a voltage, said direct power wire electrically connected to the multitude of light elements; a negative wire electrically connected to the multitude of light elements; a high voltage wire extending the length, said high voltage wire comprising a voltage in excess of the voltage of the direct power wire; said decorative light strand further comprising a plurality of DC voltage regulators arrayed over the length of the light strand with a plurality of light elements between each DC voltage regulator; wherein each voltage regulator outputs a voltage to the direct power wire that powers the light elements at the voltage of the direct power wire.

10. The decorative light strand of claim 9 wherein the multitude of light elements further comprise LEDs.

11. The decorative light strand of claim 10 wherein the LEDs further comprise RGB groups.

12. The decorative light strand of claim 9 wherein the voltage of the high voltage wire is in excess of 23 volts and the voltage of the direct power wire is under 13 volts.

13. The decorative light strand of claim 9 wherein the voltage regulators are switching voltage regulators.

14. The decorative light strand of claim 9 wherein the signal data wire, direct power wire, negative wire, and high voltage wire are traces on an elongate printed circuit board.

15. The printed circuit board of claim 14 wherein the elongate printed circuit board is flexible.

16. The decorative light strand of claim 9 wherein the plurality of light elements between each DC voltage regulator is between 5 and 100.

17. A method of illuminating a structure comprising:

selecting a structure for illumination, said structure having a length for illumination;

providing a light strand comprising a direct power wire, a negative wire, a high voltage wire and a signal data wire all having a light strand length corresponding to the length for illumination of the structure;

spacing a plurality of light engines along the light strand length;

providing a plurality of voltage regulators spaced along the light strand length;

providing a voltage to the length of the high voltage wire such that the voltage of the high voltage wire is stepped down to a lower voltage by the plurality of voltage regulators, said lower voltage provided to the direct power wire at a voltage disposed to power the plurality of light engines.

18. A method of illuminating a structure according to claim 17 further comprising the step of affixing the light strand to the structure.

19. A method of illuminating a structure according to claim 17 wherein the number of voltage regulators is selected in proportion to the number of lights.

20. A method of illuminating a structure according to claim 17 wherein the structure for illumination is a building.

* * * * *